US006455236B1

(12) United States Patent
Papai

(10) Patent No.: US 6,455,236 B1
(45) Date of Patent: Sep. 24, 2002

(54) ONE-PART BLEACH-FIX LIQUID CONCENTRATES

(75) Inventor: Laszlo Papai, Ballwin, MO (US)

(73) Assignee: Trebla Chemical Company, St. Louis, MO (US)

( * ) Notice: Subject to any disclaimer, the term of this patent is extended or adjusted under 35 U.S.C. 154(b) by 0 days.

(21) Appl. No.: 09/715,612

(22) Filed: Nov. 17, 2000

Related U.S. Application Data

(63) Continuation-in-part of application No. 09/477,565, filed on Jan. 6, 2000, now Pat. No. 6,221,570.

(51) Int. Cl.[7] ..... G03C 7/42
(52) U.S. Cl. ..... 430/458; 430/403
(58) Field of Search ..... 430/458, 403

(56) References Cited

U.S. PATENT DOCUMENTS 2,322,084 A * 6/1943 Young et al. ..... 430/393
3,293,036 A * 12/1966 Mecke et al. ..... 430/393
3,342,598 A * 9/1967 Bard ..... 430/461
3,372,030 A * 3/1968 Jacobson ..... 430/418
3,879,203 A * 4/1975 Schranz et al. ..... 430/400

* cited by examiner

*Primary Examiner*—Hoa Van Le
(74) *Attorney, Agent, or Firm*—Howard M. Ellis

(57) ABSTRACT

Compositions and methods of making photographic one-part bleach-fix liquid concentrates, packaged in a single unit, wherein the bleaching agent is a polyvalent metal oxidizing agent are described. A thiocyanate salt is added in an amount sufficient to provide one-part bleach-fix liquid concentrates that are homogeneous, remain free of crystallized precipitates for extended periods of time, and that retain effective oxidizing potential during extended periods of storage. Alternatively, the present invention provides for compositions and methods of making stable bleach-fix liquid concentrates, suitable for dilution to working strength solutions, using a polyvalent metal oxidizing bleaching agent, at least one fixing agent, and a source of phosphate ions. Precipitation, which occurs when an iron (III) bleaching agent is reduced by components of the concentrate, is prevented by the addition of thiocyanate and/or phosphate ions. If phosphoric acid is used as the source of phosphate ions, it will prevent the occurrence of precipitates and maintain the acidity of the concentrate. If desired, any phosphate salt may be used as a source of phosphate ions.

29 Claims, No Drawings

ONE-PART BLEACH-FIX LIQUID CONCENTRATES

CROSS REFERENCE TO RELATED APPLICATION

This application is a continuation-in-part of application Ser. No. 09/477,565, filed Jan. 6, 2000, U.S. Pat. No. 6,221,570.

FIELD OF THE INVENTION

This invention relates in general to photographic processing, and in particular to compositions and methods of making bleach-fix concentrates. More specifically, this invention relates to one-part bleach-fix liquid concentrates that remain free of crystallized precipitates and retain optimal oxidizing capability during extended storage.

BACKGROUND OF THE INVENTION

Color developers produce a combined silver and dye image, however, to obtain clear colors the silver image must be removed. This is accomplished by oxidizing the metallic silver with a suitable oxidizing agent, commonly referred to as a bleaching agent. Any remaining light-sensitive silver halide is then dissolved in a silver halide solvent, commonly referred to as a fixing agent. These bleaching and fixing processes may be performed sequentially in two separate solutions, or in the alternative, the bleaching agent and fixing agents can be combined into a single bleaching-fixing solution.

The form in which the bleaching and fixing agents are typically employed is a dilute aqueous solution. Thus, it is not generally feasible from an economic standpoint to package, transport, and store solutions of working strength because this would involve the packaging, transport, and storage of large amounts of water. Therefore, the bleaching and fixing solutions are prepared immediately before use by dissolving the necessary ingredients in water.

The prevalence of small photographic service laboratories using automatic processing systems that are supervised by technicians who have limited technical background requires nearly foolproof premixed solutions. However, as stated above, full working ready-to-use solutions are expensive to ship, and further, the bulky containers take up valuable storage space. To overcome these disadvantages, there has been a trend to reduce the size of packaging, and thus, provide a savings in shipping costs. One way to achieve this goal is to make either all-powder or liquid bleaching, fixing, and/or bleach fixing concentrates. These concentrates merely have to be dissolved in or diluted with water to form a working solution.

DESCRIPTION OF THE RELATED ART

A bleach/fix solution that is prepared by mixing pre-prepared bleaching and fixing solutions is disclosed in U.S. Pat. No. 5,070,004 issued to Yoshihiro Fujita et al. Preparation immediately before use is necessary because the individual components of the separate solutions chemically react and quickly decompose and/or oxidize reactive components thereby diminishing the useful life of the working solution.

Because of the serious problem of unwanted chemical reactions occurring between the components, the bleaching and fixing concentrates are usually separated into two or more parts that are subsequently combined to form a working solution. For instance, a two-part bleach-fixing liquid concentrate is disclosed in U.S. Pat. No. 4,956,268 issued to Kiyoshi Nakazyo et al, wherein a first concentrate comprises a silver halide solvent and the second concentrate contains an oxidizing agent. The components are packaged separately from each other to prevent chemical reactions that form undesirable reaction products, such as crystallized precipitates. For instance, when a bleaching concentrate containing a ferric ion solution is combined with a fixing concentrate containing a thiosulfate solution the concentrate will have a very short shelf life because the ferric ion can be reduced to a ferrous ion and the thiosulfate can sulphurize to inactivate the concentrate.

While the higher degree of concentration will reduce some of the volume of water the two separate concentrates are still not sufficiently compact to substantially reduce the cost of shipping and/or the necessary storage space.

In an attempt to provide a one-part concentrate, U.S. Pat. No. 5,310,633, issued to Yoshida et al., discloses a one-part powdery bleach-fixing composition. Powdered components tend to solve the disadvantages of shipping and storing separate liquid concentrates, but lumping or caking of the dry components, especially of the thiosulfate, can occur during shipping and/or storage thereby making it difficult to provide a homogenous solution upon dilution.

U.S. Pat. No. 3,751,251 provides for a one-part liquid bleach-fix concentrated regenerator. As described in this patent an aqueous solution of an aminopolycarboxylic acid and a thiosulfate ion are mixed with a sufficient amount of a sulfite ion, in the form of gaseous sulfur dioxide, to adjust the pH of the solution to between 5.4 and 6.0. However, this product still has a limited shelf life due to undesirable crystal formation in the concentrate.

Accordingly, there is a need for improved one-part bleach-fix liquid concentrates which can be shipped economically, require minimal storage space, eliminate the need for mixing several different components, retain oxidizing ability, and prevent crystals from forming in the concentrate.

SUMMARY OF INVENTION

It is, therefore, a primary object of the present invention to provide one-part bleach-fix liquid concentrates having stability for extended storability.

It is another object to provide one-part bleach-fix liquid concentrates wherein crystallized precipitates are essentially non-existent after a year or more of storage.

It is yet another object of the invention to provide one-part bleach-fix liquid concentrates wherein the polyvalent metal complexed oxidizing agent maintains its oxidizing ability for an extended time period.

A further object of the present invention is to provide stable one-part bleach-fix liquid concentrates that upon dilution provide working strength solutions from which silver can be recovered with reduced risk of toxic hydrogen cyanide gas formation.

A yet still further object of the present invention is to provide one-part liquid beach-fix concentrates that reduce transportation and packaging costs.

These and other objects of the present invention will be clear from the following, more detailed, description.

This inventor found that one-part bleach-fix liquid concentrates suitable for dilution to working strength solutions can be formulated to have an extended shelf life without forming crystallized precipitates by combining a bleaching agent with a thiocyanate salt fixing agent. After further investigation, it was found that when a thiocyanate salt is used and/or combined in a specific ratio with another fixing agent, crystal formation is essentially eliminated thus increasing the stability of the one-part liquid bleach-fix concentrate. Surprisingly, it was found that when the amount of the thiocyanate salt is less than the amount of the other fixing agent the oxidizing ability of the diluted working solution is not decreased even after many months of storage.

In accordance with the present invention there is provided one-part bleach-fix liquid concentrates which comprise:

a) a bleaching agent for oxidizing metallic silver; and b) a fixing mixture comprising at least a thiocyanate salt in an amount to substantially inhibit crystal formation for extending the stability and shelf-life of the liquid concentrate. The concentrate remains essentially free of crystallized precipitates during the extended shelf life.

More preferably, there is provided a first and second fixing agent wherein one fixing agent is a thiocyanate salt and the other fixing agent is selected from the group which includes thiosulfate salts, thioethers compounds, thiourea, thioglycolic acid, and the like.

The bleaching agent may be selected from the group consisting of compounds of polyvalent metals such as iron, (III), cobalt (III), chromium (VI), and copper (II); peracids; quinones; nitro compounds and mixtures thereof The compounds of the polyvalent metals may include iron (III) compounds such as ferric chloride; ferricyanide; bichromates; and organic complexes with aminopolycarboxylic acids, aminopolyphosphonic acids and organic phosphonic acids.

It was found that the polyvalent metal oxidizing agent does not precipitate out of the concentrate when a thiocyanate fixing agent is used as the sole fixing agent, or when combined with another fixing agent. Generally, the shelf life of the concentrate increases as the amount of thiocyanate salt increases in the one-part bleach-fix liquid concentrate. The thiocyanate salt in the one-part bleach-fix liquid concentrate is generally used in an amount greater than 0.1 mol/liter to less than 1 mole/liter of concentrate.

The present invention can include additional photographic processing agents; such as preservatives, alkaline agents, buffering agents, bleaching accelerators, brightening agents, anti-staining agents, defoaming agents, surfactants, fungicides, anticorrosion agents and organic solvents.

The present invention also provides for a method for processing a color photographic silver halide photosensitive material after image wise exposure using a one-part bleach-fix liquid concentrate, comprising the steps of color developing and processing with a bleach-fix solution which is a one-part bleach-fix liquid concentrate diluted with a sufficient amount of water to prepare a working strength solution. The one-part bleach-fix liquid concentrate is an aqueous solution comprising:

a) a bleaching agent which is a polyvalent metal oxidizing agent; and b) a mixture of at least a first and second fixing agent, one fixing agent being a thiocyanate salt present in an amount sufficient to inhibit crystal formation in the one-part bleach-fix liquid concentrate, to extend the shelf-life of the concentrate.

The present invention further provides a method of inhibiting the formation of crystallized precipitates in one-part bleach-fix liquid concentrates comprising the steps of:

a) providing a bleaching agent which is a polyvalent metal complexed oxidizing agent, and b) combining the bleaching agent with a mixture of at least a first and second fixing agent.

The first fixing agent is a thiocyanate salt present in an amount sufficient to inhibit crystal formation in the one-part bleach-fix liquid concentrate.

Still further, the present invention provides for a method of making one-part bleach-fix liquid concentrates comprising the step of combining a bleaching agent, which is a metal complexed oxidizing agent and at least a first and second fixing agent, at least one fixing agent being a thiocyanate salt present in an amount sufficient to inhibit crystal formation in the one-part bleach-fix liquid concentrate. The metal complexed oxidizing agent is preferably a polyvalent metal complexed oxidizing agent, and more preferably used, a polyvalent metal selected from the group of iron, copper, cobalt and chromium. When using at least two different fixing agents the thiocyanate salt is preferably used in an amount by weight less than the amount by-weight of the first fixing agent. More preferably, the thiocyanate salt is used in a sufficient amount to substantially inhibit crystal formation in the one-part bleach-fix liquid concentrate, but not exceeding an amount that will produce toxic hydrogen cyanide gas during silver recovery using electrolytic systems. The other fixing agent may be a thiosulfate salt.

Yet another embodiment of the present invention provides for a photographic bleach-fix kit comprising a one-part bleach-fix liquid concentrate, which upon dilution with a sufficient amount of water provides a working strength bleach-fix solution.

In one embodiment, the kit comprises a single package containing a concentrated aqueous solution comprising a bleaching agent, which oxidizes metallic silver, and at least a thiocyanate salt present in an amount sufficient to inhibit crystal formation in the one-part bleach-fix liquid concentrate.

Another embodiment of the one-part bleach-fix liquid concentrate kit may comprise: a concentrated aqueous solution comprising:

i) a bleaching agent which oxidizes metallic silver; and ii) a mixture of at least a first and second fixing agents. One fixing agent is a thiocyanate salt present in an amount sufficient to inhibit crystal formation in the one-part bleach-fix liquid concentrate.

The bleach-fix components in the single packaging kit have excellent shelf life characteristics because any adverse interactions between the components are effectively avoided by the optimal quantitative ratio of the fixing agents with one fixing agent being a thiocyanate salt.

The one-part bleach-fix liquid concentrates formulated with thiocyanate salt have pH values of from about 5.6 to about 5.9. When the liquid concentrates are diluted with water to yield working strength bleaching and fixing photographic solutions the pH values are from about 5.5 to about 6.0.

To maintain the pH one of the preferred acids is phosphoric acid. In using the phosphoric acid it was found that in addition to maintaining an acid pH in the stable bleach-fix liquid concentrates of this invention, phosphoric acid is particularly useful in inhibiting the formation of crystals and to extend the shelf-life of the concentrates disclosed herein.

Accordingly, it is an alternative embodiment of the present invention to provide for a stable one-part bleach-fix liquid concentrate, which comprises:

a) a photographic bleaching agent which oxidizes metallic silver;

b) at least one fixing agent, and c) a source of phosphate ions present in an amount sufficient to inhibit precipitation and to form a storage-stable, liquid concentrate having a pH value of between about 4 and about 7. The resulting one-part bleach-fix liquid concentrate is suitable for dilution with water to a working strength solution.

While phosphoric acid is a good source of phosphate ion, other available sources of phosphate ion, such as a phosphate salt, can be used as well. The silver metal oxidizing agent is preferably a polyvalent metal, and more preferably, a polyvalent metal selected from the group of iron, copper, cobalt and chromium.

The present invention further provides for a method of making a stable one-part bleach-fix liquid concentrate comprising the steps of combining a photographic bleaching agent, which oxidizes metallic silver, at least one fixing agent, and a source of phosphate ions in an amount sufficient to inhibit crystal formation. This method forms storage stable liquid concentrates with pH values of between about 4.5 and about 6.5 suitable for dilution with water to a working strength solution.

In addition, the present invention provides for stabilizing one-part bleach-fix liquid concentrates by introducing a source of phosphate ions into the concentrates in amounts sufficient to inhibit crystal formation, and to maintain the concentrates within a range of pH values that are between about 4 and about 7.

Whereas, the one-part bleach-fix liquid concentrates of the present invention can be diluted into working solutions that have excellent bleach-fixing power, they are effectively applicable to the processing of not only low speed, but also high speed light-sensitive silver halide color photographic materials. Further, the concentrates can be applied in common to the processing of all types of light-sensitive silver halide color photographic materials that are required to be bleached and fixed, such as photographic printing papers, negative color films, and reversal color films.

Concentrates of the present invention can be diluted according to the needs of the end user. The concentration of the working strength solutions, prepared from the stable concentrates, will depend on a variety of factors, such as controlling environmental regulations or the requirements of the particular automatic processor being used. In general, the dilution factor ranges from about one part concentrate to one part of water (1:1) by volume to about 1:6, and more preferably from about 1:2 to 1:4 by volume.

DETAILED DESCRIPTION OF THE INVENTION

The present invention provides compositions and methods of making one-part bleach-fix liquid concentrates packaged in a single unit, wherein the bleaching agent is a polyvalent metal oxidizing agent protected from reduction for an extended period of time by incorporating a thiocyanate fixing agent. More preferably, a quantitative ratio of at least two fixing agents are combined wherein one of the fixing agents is a thiocyanate salt used in a sufficient amount to provide homogeneous one-part liquid concentrates free, or virtually free, of crystallized components and which retain effective oxidizing potential during extended storage as a concentrate.

As stated above, if clear colors are to be obtained the silver image must be removed leaving only the dye image. This can be accomplished by oxidizing the metallic silver with a suitable oxidizing agent, commonly referred to as a bleaching agent. The one-part bleach-fix liquid concentrates as described above comprise a bleaching agent. Generally any bleaching agent, which oxidizes metallic silver, may be used in the present invention. Preferably, the bleaching agents used herein include compounds of polyvalent metals, such as iron (III), cobalt (III), chromium (VI), and copper (II); peracids; quinones and nitro compounds. Typical bleaching agents used herein are iron salts, such as ferric chloride; ferricyanides; bichromates; and organic complexes with aminopolycarboxylic acids, aminopolyphosphonic acids and organic phosphonic acids for forming the organic complex salts of iron (III) include:

nitrilotriacetic acid,
nitrilotripropionic acid,
1,2-Diaminopropanetetraacetic acid,
cyclohexanediaminetetraacetic acid,
ethylenediaminetetraacetic acid,
propylenediaminetetraacetic acid,
diethylenetriaminepentaacetic acid,
ortho-diaminecyclohexanetetraacetic acid,
ethylene glycol bis(aminoethyl ether) tetraacetic acid,
diaminopropanol tetraacetic acid,
N-(-2-hydroxyethyl)ethylenediaminetriacetic acid,
ethyliminodipropionic acid,
iminodiacetic acid,
methyliminodiacetic acid,
ethyliminodiacetic acid,
phenylenediaminetetraacetic acid,
2-Phosphonobutane-1,2,4-triacetic acid,
1,3-Diaminopropanol-N,N,N',N'-tetramethylenephosphonic acid, and the like.

Among the above, ferric aminopolycarboxylic acid is preferred, and even more preferably, ferric ethylenediamine tetraacetic acid.

The ferric complex salts of the aminopolycarboxylic acids may be used in the form of salts with sodium, potassium, ammonium, and the like, although ammonium salts are preferred for fastest bleaching.

Ferric complex salts of the aminopolycarboxylic acids may be used in the form of a complex salt. Alternatively, the complex salt of the ferric ion may be formed in a solution of an aminopolycarboxylic acid with a ferric salt, such as ferric sulfate, ferric chloride, ferric nitrate, ferric ammonium sulfate or ferric phosphate. When a complex salt is used, it is possible to use one type of complex salt, or a mixture of two or more types of complex salt. On the other hand, when the complex salt is formed in the solution using a ferric salt and an aminopolycarboxylic acid, it may be formed using one or more than one type of ferric salt. Moreover, the ferric complex salt may also be formed using one or more than one type of aminopolycarboxylic acid.

Generally, the bleaching agent should be used in a sufficient amount to effectively oxidize any metallic silver remaining on the photographic material. More specifically, the bleaching agent may be present in an amount from about 10 percent to about 25 percent, and more preferably from about 15 percent to about 20 percent based on total weight of the concentrate.

As described above, any remaining light-sensitive silver halide must be dissolved in a silver halide solvent, commonly referred to as a fixing agent. Because the silver halides are almost insoluble, they cannot be removed from the emulsion by water washing, but instead must be treated with a fixing agent, which reacts with the silver halides to form soluble complex salts. Thus, in addition to the bleaching agent, at least one fixing agent must be incorporated into the one-part bleach-fix liquid concentrates of the present invention.

In the present invention, any fixing agent that dissolves light-sensitive silver halides without affecting the silver image without causing excessive swelling or softening of the gelatin layer, may be used. Thiosulfates, thiocyanates, thioether compounds, thiourea, and thioglycolic acid are the most important with the proviso that when thiocyanate salt is used, it is used either alone or in combination with a different and distinct fixing agent.

Although thiocyanate salts are used as fixing agents, they have limited applications. Thiocyanate salts find some application in ultra-rapid processing systems, as they are more rapid than ammonium thiosulfate. However, because they tend to soften gelatin, the emulsion should be well-hardened and the fixing time very short. Thiocyanate salts also are much more expensive than thiosulfate salts. Even more important, during silver recovery using electrolytic methods there is a possibility of producing toxic hydrogen cyanide gas. In the past, these disadvantages rendered the use of thiocyanate salts as a fixing agent undesirable, as it was neither economical nor reliable.

In spite of the above disadvantages, it has been discovered that using a thiocyanate salt either alone or in combination with another fixing agent provides unexpected advantages and benefits. Further, it has been found that mixing a quantitative amount of a thiocyanate salt with another fixing agent, in a ratio as disclosed herein, provides one-part bleach-fix liquid concentrates with excellent properties. These include both a long shelf life free from crystalline precipitates and the retention of oxidizing capacity when the concentrates are diluted to working strength solutions. This is surprising and unexpected. That is, when a mixture of fixing agents contains an amount of a thiocyanate salt, ranging from about 5 to about 20 percent, and more preferably from about 7 percent to about 15 percent by weight based on the total weight of the fixing agents, a homogenous concentrate essentially free of crystals even after months of storage is formed.

Typically, any thiocyanate salt may be used having a cation selected from sodium, potassium, ammonium, lithium and the like, and preferably ammonium thiocyanate.

Generally, the thiocyanate salt should be used in an amount sufficient to inhibit crystallized precipitates for an extended period of time. More specifically, the thiocyanate salt may be present in an amount from about 1 percent to about 7 percent, and more preferably, from about 1.5 percent to about 5 percent based on total weight of the bleach-fix concentrate.

Although the theory of the crystallization is not perfectly clear, it is known that the precipitate is comprised primarily of salts of the aminopolycarboxylic acid, such as ferrous complexes of the aminopolycarboxylic acid. It is believed that the ferrous complex has a lower solubility than a ferric complex. A solution containing these crystals demonstrates unsatisfactory bleaching capability. That is, the ability to oxidize metallic silver to a silver ion is greatly reduced. While not wishing to be bound by any particular theory of mechanism, it is believed that the inclusion of thiocyanate ions keeps the ferrous ions in solution, thus preventing their crystallization and precipitation.

When using two different fixing agents (where one is thiocyanate) in the concentrates of the present invention, any fixing agent (other than a thiocyanate salt) which acts as a silver halide solvent may be used, including thiosulfates, thioether compounds, thiourea, thioglycolic acid and mixtures thereof. Preferably, a thiosulfate salt is used such as sodium thiosulfate, potassium thiosulfate, ammonium thiosulfate, lithium thiosulfate, and guanidine thiosulfate, and more preferably, ammonium thiosulfate. Ammonium thiosulfate is preferred because solutions containing this fixing agent show a higher rate of fixation than sodium thiosulfate solutions.

The other fixing agent should be used in an amount sufficient to solubilize any remaining inactivated silver halide. More specifically, the other fixing agent may be present in an amount from about 20 percent to about 30 percent, and more preferably, from about 22 percent to about 26 percent based on total weight of the concentrate.

It should be noted, that some of the additives encompassed by this invention have been previously used in full working strength solutions. However, heretofore, working solutions were not made from a one-part bleach-fix liquid concentrate, but instead were prepared immediately before use in the bleaching, fixing, or bleach-fix process. Moreover, it was unknown, heretofore, that a specific ratio of a thiocyanate salt to an additional fixing agent combined in a one-part bleach-fix liquid concentrate could provide such unexpected results as those demonstrated in the present invention.

The one-part bleach-fix liquid concentrates may contain bleaching agents and fixing agents, including a thiocyanate salt. They may further contain preservatives, acids, alkaline agents, buffering agents, anti-staining agents, and minor amounts of bleaching accelerators, brightening agents, defoaming agents, surfactants, fungicides, anticorrosion agents and organic solvents.

The concentrates of the present invention may contain an effective amount of a preservative for stabilization of a thiosulfate salt fixing agent to reduce any decomposition that may occur due to the oxidizing components in the concentrate. Especially useful for this purpose are sulfurous acid ion releasing compounds such as a sulfite. Sulfites which can be employed as preservatives include such representative examples as sodium sulfite, lithium sulfite, potassium sulfite, ammonium sulfite, sodium bisulfite, ammonium bisulfite, potassium metabisulfite, sodium formaldehyde bisulfite and the like.

Other preservatives that can be used include hydroxylamine, hydrazine, a bisulfite addition product of an aldehyde compound, such as sodiumacetaldehyde bisulfite.

Generally, the preservative should be used in a sufficient amount to be effective in protecting the fixing agents from decomposition. More specifically, the preservative may be present in an amount from about 5 percent to about 20 percent, and more preferably, from about 10 percent to about 15 percent based on total weight of the concentrate.

The one-part liquid bleach-fix concentrates of the present invention may further comprise an alkaline agent which becomes basic or alkaline when the concentrates are diluted to a working solution with water. The alkaline agent provides the desired pH level for photographic performance. Generally, the alkaline agents used are ammonium, potassium, and sodium hydroxide and preferably, ammonium hydroxide.

The alkaline agent should be introduced into the bleach-fix concentrates in an amount sufficient to maintain the desired pH in the dilute working strength solution. Typically, an alkaline agent is added in an amount from 0.05 percent to about 3 percent based on total weight of the concentrate.

When photographic materials are transferred from the development bath to the bleach-fix solution it is necessary to neutralize the alkali in the developer to inhibit further development of the image. If the alkali is not neutralized, the bleach-fix solution can become contaminated with reduced effectiveness. Thus understood, the use of an acid will help to buffer the solution and prevent stains when development of the latent image is not arrested. Practically any acid will function as an anti-staining agent, however, organic acids are more suitable than inorganic acids because they are less dissociated, and therefore, have a correspondingly smaller tendency to precipitate sulfur from the bleach-fix concentrate or the working solutions made from the concentrates. Well-known acids, including organic and inorganic acids, useful for preventing staining and maintaining an acidic pH in the working solutions include formic acid, acetic acid, monochloroacetic acid, glycolic acid, propionic acid, phosphoric acid, maleic acid, succinic acid, and the like. Among these, preferred acids have a carboxyl group, and most preferred is acetic acid. A full explanation for the superior results of the one-part bleach-fix liquid concentrates has not yet been arrived at. By way of theory only and without limitation, it is suggested that with the further inclusion of acetic acid/acetate ions in the concentrates of the present invention, the ferric/ferrous complex is further stabilized thereby extending the crystal free period within the concentrates.

It is beneficial to add the acid in an amount to stop further oxidation of the developer and prevent staining of the photographic materials. Preferably, the acid can be added in an amount from about 1 percent to about 5 percent based on total weight of the concentrate.

In addition to modifying the pH of the concentrate and preventing staining, it has been discovered that the use of phosphoric acid also results in a stable concentrate that remains free from $Fe^{2+}$ precipitates for extended time periods. Typically, reducing agents such as sulfites in the bleach-fix concentrate reduce the $Fe^{3+}$ of the bleaching agents to the $Fe^{2+}$ state. Normally, $Fe^{3+}$ compounds are less soluble compared to those containing $Fe^{2+}$. However, when iron is part of a bleaching agent compound, the solubility of ferrous and ferric iron compounds reverses. This results in precipitation of the ferrous iron containing bleaching agents. Any precipitate formation in a concentrate immediately ends the effectiveness and shelf life of the concentrate.

It has been observed that when phosphoric acid, or any other source of phosphate ion, is used in the concentrate, the phosphate ion acts to keep the $Fe^{2+}$ bleaching agent in solution. This prevents precipitates from forming, thus, increasing both the effectiveness of the concentrate and its shelf life.

Furthermore, it has been observed that phosphoric acid prevents ferrous iron precipitation to such an extent that it can, by itself, stabilize the one-part bleach-fix concentrate to provide a concentrate with an increased shelf life capacity.

When phosphoric acid is used as a source of phosphate ion, it serves to control the pH of the concentrate. If a phosphate salt, rather than phosphoric acid, is used as the source of phosphate ion, then the addition of acid may be needed to prevent staining and to maintain the pH of the concentrate to values between about 4 and about 7, and more specifically, from values between about 5 and about 6.

If a phosphate salt is used instead of the phosphoric acid, additional acid may be required to maintain the desired pH and prevent staining. Representative phosphate salts may include trisodium phosphate, disodium monohydrogen phosphate, monosodium dihydrogen phosphate, tripotassium phosphate, dipotassium monohydrogen phosphate, monopotassium dihydrogen phosphate, triammonium phosphate, diammonium monohydrogen phosphate, and monammonium dihydrogen phosphate, to name but a few.

Further, it has been observed that the shelf life of the concentrate increases as the amount of phosphate ion is increased (as shown by Examples 5 and 6, below). The amount of phosphate that is used is generally from about 0.5 to about 8.0 percent wt/wt.

The bleaching agent may be selected from the group consisting of compounds of polyvalent metals such as iron, (III), cobalt (III), chromium (VI), and copper (II), peracids, and mixtures thereof Preferably, the compounds of the polyvalent metals would include iron (III) compounds such as ferric chloride; ferricyanide; bichromates; and organic complexes of iron (III) with aminopolycarboxylic acids, aminopolyphosphonic acids and organic phosphonic acids. From the above, the ferric aminopolycarboxylic acid is preferred, and more preferably, ferric ethylenediamine tetraacetic acid. The bleaching agent is typically used in an amount of from about 1.0 to about 35 percent wt/wt.

The fixing agent is selected from the group that includes thiosulfate salts, thiocyanate salts, thioethers, thiourea, thioglycolic acid, and the like, where thiosulfate is preferred. The fixing agent is generally present in an amount of from 10 percent to about 55 percent wt/wt.

The present invention may further provide a re-halogenating agent, for example, bromides, such as potassium bromide, sodium bromide, and ammonium bromide; and chlorides, such as potassium chloride, sodium chloride, and ammonium chloride.

The stable one-part liquid bleach-fix concentrates of the present invention have excellent bleach-fixing power, and hence, a bleaching accelerator is not necessary. Notwithstanding, if desired, a bleaching accelerator may be incorporated. Representative examples of useful bleaching accelerators include organic sulfur compounds, quaternary ammonium compounds and selenium compounds.

Usually, it is desirable that working strength bleach-fix solutions be used immediately after color development. Dilution of the one-part bleach-fix liquid concentrates of the present invention may be accomplished using tap, deionized, or sterilized water. Upon dilution to working strength solutions, the one-part bleach-fix liquid concentrates may be used effectively for bleaching and fixing photographic materials In the bleach-fixing process agitation of the working solution ensures that more of the bleach-fix agents are available to the photographic materials being treated. This results in an increased bleaching and fixing rate. Agitation can be achieved by various techniques including injection of a jet flow of processing solution against the surface of the photosensitive material or increasing the rate of circulation flow through the entire processing solution. The photographic material may be treated in bleach-fix working solution for generally up to 150 seconds, and preferably up to 60 seconds.

The one-part bleach-fix liquid concentrates may be used in automatic processors. In general, automatic processors perform continuous processing in either a "replenishment" or "batch" mode. In the replenishment mode, replenisher is made up in amounts proportional to the quantity of color photosensitive material processed in order to keep the performance of processing solutions constant. In the batch mode all or part of the used processing solution is replaced with a fresh solution whenever the quality of color photo sensitive material processed reaches a predetermined level.

When regeneration mode is used, silver recovery is necessary to regenerate spent bleach-fix solutions to permit their reuse. As part of the regeneration, it is necessary to remove the silver from the spent bleach-fix solution, and this is most advantageously accomplished by the use of electrolytic silver recovery systems. Such systems function to plate out the dissolved silver as metallic silver on the cathode of the electrolytic apparatus. After a sufficient amount of silver has been collected on the cathode, it is removed from the cathode and. subjected to appropriate refining processes to permit its reuse. Conditions used in carrying out the electrolytic silver recovery are varied but higher temperatures and increased current density can cause the formation of toxic fumes when the fixing agent is a thiocyanate salt. However, by combining a thiocyanate salt with an additional fixing agent the concentration of thiocyanate is low enough to reduce the production of any significant amount of hydrogen cyanide gas.

In the following examples, the amounts given in units of grams refer to the associated named pure chemical.

EXAMPLE 1

One liter of a one-part bleach-fix liquid concentrate was prepared using the following basic formulation as shown below:

| | |
|---|---|
| Ammonium thiosulfate | 310.0 g |
| Ammonium bisulfite | 150.0 g |
| Aqua ammonia | 9.5 g |
| Ferric ammonium BDTA | 220.0 g |
| Acetic Acid | 37.0 g |
| Ammonium thiocyanate | 30.0 g |
| pH 5.70–5.80 | |

The components were added sequentially in a single vessel providing approximately 1 liter of the one-part concentrate of the present invention. The vessel was placed in storage at ambient pressure and at a temperature of approximately 20° C. The one-part liquid concentrate prepared according to the above formulation remained crystal free even after 14 months of storage.

COMPARATIVE EXAMPLE 2

To illustrate the importance of including at least some thiocyanate salt to prevent crystallized precipitates forming in the concentrates of the present invention, one liter of a one-part concentrate was prepared without the addition of any thiocyanate salt according to the following formula:

| | |
|---|---|
| Ammonium thiosulfate | 387.5 g |
| Ammonium bisulfite | 150.0 g |
| Aqua ammonia | 9.5 g |
| Ferric ammonium EDTA | 220.0 g |
| Acetic Acid | 37.0 g |
| pH 5.70–5.80 | |

The components were added to a single vessel providing approximately 1 liter of a one-part concentrate. It should be noted that the concentration of the thiosulfate salt was increased because an additional fixing agent was not included in the concentrate. The vessel was placed in storage at ambient pressure and at a temperature of approximately 20° C.

Results: The one-part liquid concentrate prepared without the addition of a thiocyanate salt produced crystallized precipitates in the concentrate in approximately one month indicating the importance of including a sufficient amount of a thiocyanate salt to provide a one-part concentrate that is essentially free of crystallized precipitates.

EXAMPLE 3

Several different concentrations of a thiocyanate salt were added to the formulation of Example 1 to illustrate the increasing shelf life of the concentrates with the addition of increasing amounts of the thiocyanate salt in the concentrates of the present invention.

TABLE 1

| Amount of Ammonium Thiocyanate | Amount of Ammonium thiosulfate | Time period free of crystals |
|---|---|---|
| 10 g | 310.0 g | 5 months |
| 20 g | 310.0 g | 10 months |
| 30 g | 310.0 g | >14 months |
| 40 g | 310.0 g | >14 months |
| 300 g | 0 | >24 months |

The above results illustrate that the shelf life of the one-part bleach-fix liquid concentrates may exceed one year by the addition of at least 30 g of a thiocyanate salt. When a thiocyanate salt was added without the addition of another fixing agent the concentrate did not form crystals in two years. However, it should be noted that high concentrations of thiocyanate salt may form toxic hydrogen cyanide gas during electrolytic recovery of silver from a spent bleach-fix solution.

EXAMPLE 4

The formulation of Example 1 prepared without the addition of acetic acid to the one-part bleach-fix concentrate:

| | |
|---|---|
| Ammonium thiosulfate | 310.0 g |
| Ammonium bisulfite | 150.0 g |
| Ferric ammonium EDTA | 220.0 g |
| Ammonium thiocyanate | 30.0 g |
| pH 5.70–5.80 | |

Results: The lack of acetic acid in the concentrate obviated the need for an alkaline agent to help buffer the acid. It was found that this formulation produced crystals in about 6–7 months. Clearly, the acetic acid plays a role in the stabilization of the one-part concentrates. While not wishing to be bound by any specific mechanism of action, it is believed that the acetic acid either further stabilizes the iron complex or simply increases the buffer capacity of the concentrate.

EXAMPLE 5

To demonstrate the efficacy of phosphate ions in inhibiting crystal formation and increasing shelf-life expectancy of one-part bleach-fix concentrates, the following experiment was conducted. One liter of a one-part bleach-fix concentrate using phosphoric acid as a source of phosphate ion was prepared with the following formulation:

| | |
|---|---|
| Ammonium thiosulfate | 450 g |
| Ammonium bisulfite | 100 g |
| Ammonium hydroxide | 30 g |
| Ferric ammonium EDTA | 300 g |
| Phosphoric acid | 64 g |

The components were added to a single vessel in the order presented to provide one liter of stable one-part bleach-fix concentrate.

Additionally, a second concentrate sample using the same ingredients and concentrations was prepared, but without phosphoric acid as a control.

The stability of both samples was tested using the following accelerated test protocol. A 200 ml aliquot of each of the samples was placed in a 250 ml beaker. The beakers were left uncovered and maintained at ambient conditions on a laboratory table. The samples were monitored for precipitate formation by visual inspection. The first precipitate to form was observed as a small crystallite floating on the surface of the concentrate. The two concentrates were then allowed to age for two more days under ambient conditions. At the completion of day two, the concentrates were quickly poured out of their respective 250 ml beakers so that the bottom of the beakers could be inspected for the presence of crystals. During the two extra days of aging, crystal growth was enough for precipitates to settle to the bottom of the beaker where they were readily observed. The time between preparation of the formulations and the observation of crystals on the bottom of the beakers was noted and used to estimate the shelf-life of samples prepared in the same manner but kept in closed, larger (commercial size) containers. Samples that are stored in closed, commercial sized containers remain free from crystallized precipitates for much longer periods of time as was observed when similar experiments were conducted using the thiocyanate concentrate (see Example 1), as described below.

During the past two years, accelerated stability tests were performed on a series of samples made using thiocyanate instead of phosphoric acid (see Example 3, for example). Using the results of these experiments, a table was constructed showing the relationship between the time required for precipitates to form in the concentrate samples that were stored in small, open containers and the time required for precipitates to form in separate aliquots of the same samples when stored in closed, larger commercial sized containers (see Table 2). Generally, samples are monitored for an estimated shelf life of only up to a year as other ingredients in bleach-fix formulations will have degraded by that time.

TABLE 2

ACCELERATED STABILITY TEST DATA

| PART A: OBSERVED SHELF LIFE Periods of time from concentrate preparation to formation of crystals in concentrates. Concentrates were prepared using varying amounts of thiocyanate and stored in an open 250 ml beaker under ambient conditions. | PART B: ESTIMATED SHELF LIFE Estimated shelf life of the concentrates of Part A when stored in a large, closed containers. The estimates are based on the known shelf life of the thiocyanate concentrate as prepared in Example 1. |
|---|---|
| 55 days | >>1 year |
| >20 days | >1 year |
| 20 days | 1 year |
| 11 days | 6 months |
| 5 days | 3 months |
| 2 days–Control | no shelf life |

Accelerated testing of the phosphate containing concentrate of Example 5 showed that this formulation, when stored in a small open container, remained free from $Fe^{2+}$ precipitates for over six months. Using the data given in Table 2, it can be estimated that the phosphate containing concentrate, when stored in a large, closed container will have a stable shelf life of greater than one year. Accelerated testing of the control, without phosphate, showed precipitate forming within two days. Table 2 shows that if crystals form within two days the concentrate has no practical shelf life. This result clearly illustrates the advantage gained by using a source of phosphate ion in the one-part bleach-fix concentrate.

EXAMPLE 6

To demonstrate that phosphate ions, even in reduced amounts, are effective in inhibiting crystal formation and increasing shelf-life expectancy of one-part bleach-fix concentrates, the following experiment was conducted. One liter of a one-part bleach-fix concentrate was prepared having the formulation:

| | |
|---|---|
| Ammonium thiosulfate | 236 g |
| Ammonium bisulfite | 50 g |
| Ammonium hydroxide | 20 g |
| Ferric ammonium EDT | 120 g |
| Phosphoric acid | 8 g |

This concentrate was prepared in the same manner as Example 5 and was subjected to accelerated testing following the protocol described above.

When a 200 ml portion of this concentrate was stored in an open, 250 ml container under ambient conditions, it remained free from precipitate for 11 days. This observation translates, according to Table 2, to an estimated shelf life of about 6 months for a sample prepared in the same manner and stored in a closed, larger container.

Examples 1–6 are presented as illustrations of different embodiments of the present invention, however, the scope of the invention is not limited to the examples.

I claim:

1. A photographic one-part bleach-fix liquid concentrate comprising:

a) a bleaching agent, b) at least one fixing agent, and c) a source of phosphate ions present in an amount sufficient to inhibit crystal formation and to form a storage stable one-part bleach-fix liquid concentrate suitable for dilution to a working strength solution, said concentrate having a pH value of between about 4 and about 7.

2. The concentrate of claim 1 wherein said source of phosphate ions is an inorganic phosphate.

3. The concentrate of claim 2 wherein said inorganic phosphate is phosphoric acid.

4. The concentrate of claim 2 wherein said inorganic phosphate is a phosphate salt.

5. The concentrate of claim 4 wherein said phosphate salt is a member selected from the group consisting of trisodium phosphate, disodium monohydrogen phosphate, monosodium dihydrogen phosphate, tripotassium phosphate, dipotassium monohydrogen phosphate, monopotassium dihydrogen phosphate, triammonium phosphate, diammonium monohydrogen phosphate and monammonium dihydrogen phosphate.

6. The concentrate of claim 4 including a pH modifying substance.

7. The concentrate of claim 6 wherein said pH modifying substance is a member selected from the group consisting of inorganic and organic acids.

8. The concentrate of claim 7 wherein said inorganic acid is selected from the group consisting of phosphoric, hydrochloric, sulfuric and nitric acids.

9. The concentrate of claim 7 wherein said organic acid is selected from the group consisting of acetic, succinic, maleic and glycolic acids.

10. The concentrate of claim 1 wherein said bleaching agent is a metal oxidizing agent selected from the group consisting of iron (III), cobalt (III), chromium (VI), copper (II) and peracid compounds.

11. The concentrate of claim 10 wherein said iron (III) compound is selected from the group consisting of iron (III) salts and iron (III) complexes of aminopolycarboxylic acid.

12. The concentrate of claim 11 wherein said iron (III) aminopolycarboxylic complex is ferric ammonium EDTA.

13. The concentrate of claim 1 wherein said fixing agent is selected from the group consisting of thiosulfate salts, thiocyanate salts, thioglycolic acid, thioethers and thiourea.

14. The concentrate of claim 13 wherein said thiosulfate salt is ammonium thiosulfate.

15. The concentrate of claim 1 including an alkaline agent selected from the group consisting of ammonium, potassium and sodium hydroxides.

16. The concentrate of claim 1 including a preservative.

17. The concentrate of claim 1 comprising from about 1 to about 35 percent wt/wt of said bleaching agent, from about 10 to about 55 percent wt/wt of said fixing agent, and from about 0.5 to about 8 percent wt/wt of said source of phosphate ions.

18. A one-part bleach-fix liquid concentrate comprising:

a) a ferric carboxylic acid complex bleaching agent, b) a thiosulfate fixing agent, and c) a source of phosphate ions present in an amount sufficient to inhibit crystal formation and to form a storage stable one-part bleach-fix liquid concentrate suitable for dilution to a working strength solution, said concentrate having a pH value of between about 4.5 and about 6.5.

19. A method for stabilizing a one-part bleach-fix liquid concentrate comprising:

a) a bleaching agent, b) at least one fixing agent, and c) a source of phosphate ions present in an amount sufficient to inhibit crystal formation and to form a storage stable one-part bleach-fix liquid concentrate suitable for dilution to a working strength solution, which method comprises the steps of introducing a source of phosphate ions into said concentrate in an amount sufficient to inhibit crystal formation, and maintaining said concentrate at a pH value of between about 4 and about 7.

20. The method of claim 19 wherein said source of phosphate ions is an inorganic phosphate.

21. The method of claim 20 wherein said inorganic phosphate is phosphoric acid.

22. The method of claim 20 wherein said inorganic phosphate is a phosphate salt.

23. The method of claim 22 wherein said phosphate salt is a member selected from the group consisting of trisodium phosphate, disodium monohydrogen phosphate, monosodium dihydrogen phosphate, tripotassium phosphate, dipotassium monohydrogen phosphate, monopotassium dihydrogen phosphate, triammonium phosphate, diammonium monohydrogen phosphate and monammonium dihydrogen phosphate.

24. The method of claim 22 including a pH modifying substance.

25. The method of claim 24 wherein said pH modifying substance is selected from the group consisting of inorganic and organic acids.

26. The method of claim 25 wherein said inorganic acid is selected from the group consisting of phosphoric, hydrochloric, sulfuric and nitric acids.

27. The method of claim 25 wherein said organic acid is selected from the group consisting of acetic, succinic, maleic and glycolic acid.

28. A photographic processing kit comprising a one-part bleach fix concentrate, said concentrate comprising:

a) a bleaching agent, b) at least one fixing agent, and c) a source of phosphate ions present in an amount sufficient to inhibit crystal formation and to form a storage stable one-part bleach fix liquid concentrate suitable for dilution to a working strength solution, said concentrate having a pH value of between about 4 and about 7.

29. The photographic processing kit of claim 28 including containers of developer and stabilizer.

* * * * *